United States Patent [19]

Combe

[11] Patent Number: 5,033,546

[45] Date of Patent: Jul. 23, 1991

[54] PRODUCTION SIMULATION PROCESS BY PILOT TEST IN A HYDROCARBON DEPOSIT

[75] Inventor: Jean Combe, Bougival, France

[73] Assignee: Institut Francais du Petrole, Rueil Malmaison, France

[21] Appl. No.: 459,283

[22] Filed: Dec. 29, 1989

[30] Foreign Application Priority Data

Dec. 30, 1988 [FR] France ..... 88 17602

[51] Int. Cl.[5] ..... E21B 43/24; E21B 43/30; E21B 47/00

[52] U.S. Cl. ..... 166/245; 166/252; 166/272; 166/50; 166/52

[58] Field of Search ..... 166/245, 250, 252, 263, 166/50, 52, 272

[56] References Cited

U.S. PATENT DOCUMENTS 4,385,662 5/1983 Mullens et al. ..... 166/50 X 4,598,770 7/1986 Shu et al. ..... 166/245

*Primary Examiner*—George A. Suchfield

*Attorney, Agent, or Firm*—Antonelli, Terry, Stout & Kraus

[57] ABSTRACT

The invention relates to a production simulation process by pilot test in a deposit (1) of hydrocarbons contained ina reservoir (2) with the aid of injection wells (3*b*, 5*b*; 7*b*) and producing wells (4*b*, 6*b*, 8*b*) with horizontal drains, said drains forming, at least in part, a polygonal geometric shape in one plane of the reservoir.

By the simulation process:

- a first state is triggered either by injection or by production for the drains located at the periphery of said geometric shape,
- a second state, opposite said first state, is triggered either by injection or by production for the drains located inside said geometric shape.
- the volumetric flowrates of liquid injected and produced are regulated such that the sum of the flowrates of the injection drains is substantially equal to the sum of the flowrates of the production drains.

8 Claims, 1 Drawing Sheet

1
2
3
3a
3b
4
4a
4b
5
5a
5b
6b
7b
8b
X
Y
H

PRODUCTION SIMULATION PROCESS BY PILOT TEST IN A HYDROCARBON DEPOSIT

The present invention relates to a production simulation process by a pilot test on a hydrocarbon deposit in a reservoir, as well as a well-drilling arrangement used to implement such a process.

Production of hydrocarbons contained in a reservoir from a deposit entails enormous expense both because of the size of the equipment that must be used and because of the quality of work necessary for bringing about this production. Also, once the geological and geophysical prospecting program is over, exploratory wells or boreholes are sunk at the site that may contain hydrocarbons allowing the nature of the rocks traversed to be established, as well as the quality of the hydrocarbons in the reservoir. After the exploratory drilling, one may discover whether the reservoir does indeed contain oil, but even then an analysis must be made to see whether the deposit discovered is commercially exploitable. It is necessary to drill confirmation boreholes to delimit the size of the deposit and estimate the volume of petroleum in the reservoir rock.

Assisted recovery methods may then be used. A fluid is injected into the reservoir through an injection well to shift the oil to the producing wells where the effluents are raised to the surface. The injected fluid may be water vapor, gas, chemicals, or any other fluid.

In order to evaluate in the field the effectiveness of a given assisted recovery process to improve production of the hydrocarbons contained in the reservoir, pilot tests are performed, consisting of a small-scale simulation of production from the deposit using several wells. The wells are drilled close to each other (by comparison to the distances used in actual production). After the pilot test, its effectiveness and success depend on its interpretation with a view to extending the assisted recovery process to the entire hydrocarbon reservoir.

Pilot tests are currently conducted using vertical well systems, the most usual being systems with 4, 5, or 7 wells (four, five, or seven spot pattern). Some of these vertical wells are used as injection wells and others as producing wells.

By appropriately choosing injection wells in the pattern of drilled wells, it may be possible to delimit the perimeter of the zone from which the oil produced is coming and thus evaluate the effectiveness of the assisted recovery process employed by comparing production to the oil initially in place in the extraction zone in question.

However, the use of vertical wells to confine the pilot test zone requires a significantly higher injection flowrate than the production flowrate obtained, so that more fluid is injected than is produced.

Another disadvantage of vertical wells, which is often detrimental to interpretation of the pilot test after it has been performed, is that the vertical wells pass through only a small reservoir depth such that the measurements and samples collected in the wells give only a partial picture—at only a few points of the reservoir.

Finally, when assisted recovery is carried out by chemical processes, the high flowrate entails prohibitive costs, particularly if the reservoirs are thin and fairly deep.

The goal of the present invention is to overcome the above disadvantages of the present pilot test systems by injecting fluid at lower flowrates, thus considerably cutting the cost of implementation.

The core idea of the present invention is to use the advantages of horizontal wells, i.e. wells having an initial practically vertical portion starting at the surface, followed by a curved portion and a portion composed of an essentially horizontal drain extending into the reservoir. The arrangement of the drains in the reservoir is such as to form a polygonal shape which then exactly delimits the testing area from which the oil will be extracted; since certain drains are used for injection and others for production, the sum of the flowrates of the injector drains is substantially equal to the sum of the flowrates of the producing drains.

Hence, the object of the present invention is a production simulation process by a pilot test in a hydrocarbon deposit inside a reservoir with the aid of injection wells through which a fluid, whose purpose is to displace said hydrocarbons to the producing wells from which the effluents are brought to the surface, is injected into said reservoir, characterized by said injection and producing wells being wells drilled practically vertically from the surface, extended by essentially horizontal drains inside said reservoir, said horizontal drains forming, at least in part, a polygonal geometric shape in a reservoir plane;

- a first state is triggered either by injection or by production for the drains located at the periphery of said geometric shape,
- a second state, opposite said first state, is triggered either by injection or by production for the drains located inside said geometric shape,
- the volumetric flowrates of liquid injected and produced are regulated such that the sum of the flowrates of the injection drains is substantially equal to the sum of the flowrates of the production drains.

In one preferred embodiment, the geometric shape is made of a rectangle whose long sides are limited by two parallel horizontal drains, a third drain being disposed in parallel and at substantially equal distances from the first two. The two drains located on the perimeter are then operated for injection or production at a flowrate q/2 and the center drain is operated for injection or production at a flowrate q.

According to a first particular characteristic, the injection fluid is steam.

According to a second particular characteristic, the injection fluid is a chemical such as, in particular, a polymer.

The present invention also covers a well-drilling arrangement for a pilot test used to implement the production simulation process as described above, characterized by the horizontal drains being drilled essentially half way between the roof and the base of the reservoir.

Advantageously, three horizontal drains are disposed in parallel in the reservoir, whereby X designates the horizontal length of one drain, Y designates the distance separating two adjacent drains, H designates the thickness of the reservoir which is a maximum of 10 m, and distances X and Y are chosen such that the inequalities $Y \geqq 5H$ and $X \geqq 4Y$ are true.

Finally, in a preferred embodiment, the drilling arrangement according to the invention is applied to a thin sandstone reservoir which has no continuous impermeable intercalated bed between the drains, and which has a small initial pressure gradient.

A particular embodiment of the invention will now be described in detail, which will clarify the essential characteristics and advantages, it being understood, however, that this embodiment is chosen as an example and is not limitative. Its description is illustrated by the attached drawings wherein.

Figures 1, 2, 3:
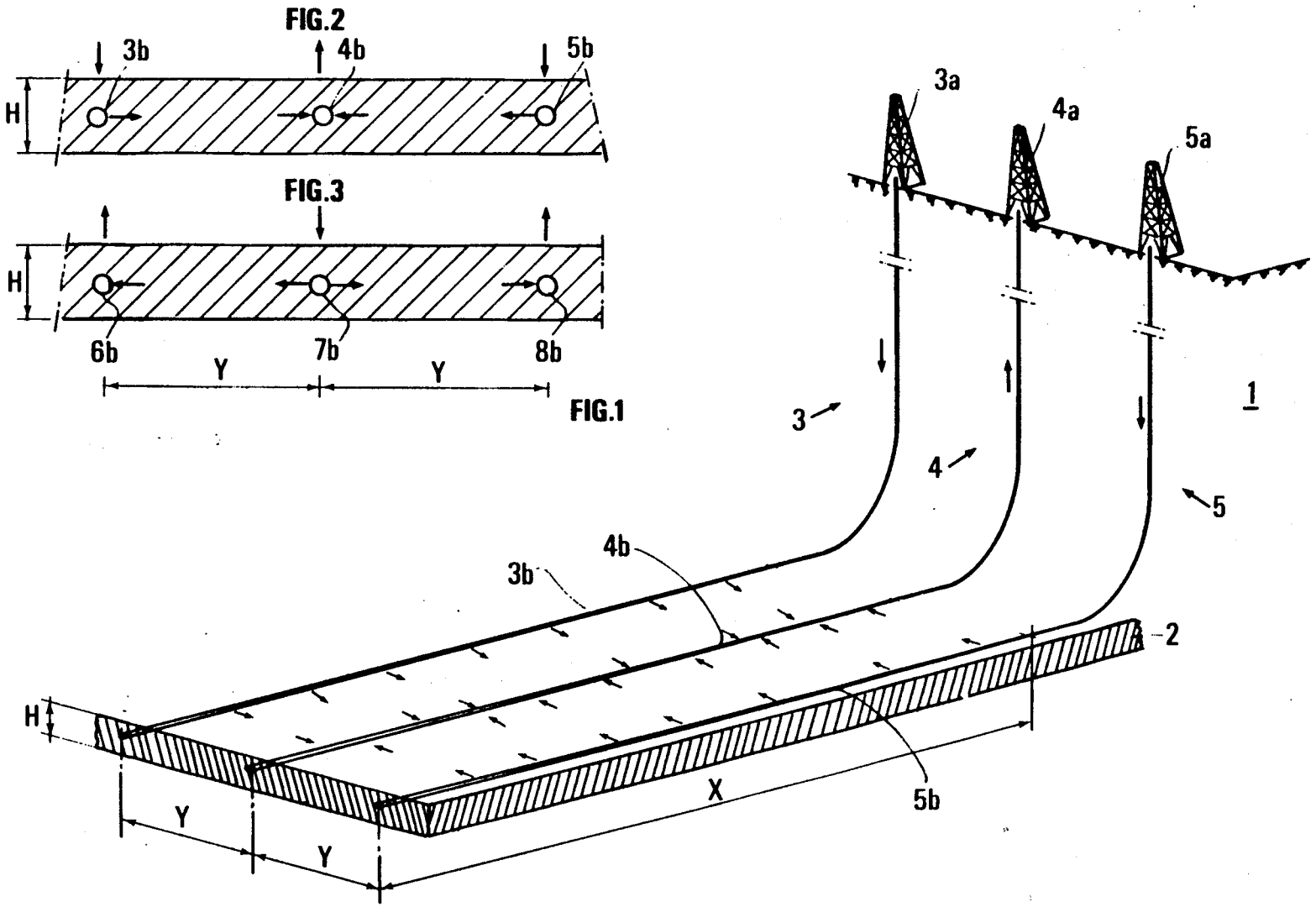
FIG. 1 represents the arrangement of wells with horizontal drains in a deposit.
FIG. 2 represents a first embodiment of a pilot test in a sectional plane of the reservoir.
FIG. 3 represents a second embodiment of a pilot test.

FIG. 1 shows a well-drilling device for a pilot test having three wells 3, 4, 5 whose initial portions 3*a*, 4*a*, 5*a*, starting from the surface, are practically vertical and are extended by drains 3*b*, 4*b*, 5*b* extending substantially horizontally into the reservoir. In this embodiment, drains 3*b*, 5*b* delimit the perimeter of a rectangle, drain 4*b* being parallel to and between drains 3*b*, 5*b*. These three horizontal drains are open for a length X within the reservoir, approximately at a horizontal distance Y from each other. The thickness of the reservoir is H. The arrangement meets the following conditions: $Y \geqq 5H$ and $X \geqq 4Y$.

Center drain 4*b* is placed in production at a flowrate q. Outer drains 3*b*, 5*b* delimiting the perimeter of the rectangle are simultaneously made to inject at a flowrate of q/2 each, such that the volumetric flowrates of injected and produced liquid, considered under the conditions of the deposit, are equal.

This system shown in FIG. 2 by descending arrows above drain 3*b*, 5*b* to represent injection and an ascending arrow for drain 4*b* to represent production, allows effective pilot tests to be run for so-called "water injection" and "chemical" hydrocarbon recovery processes.

Such a configuration offers indubitable advantages over the arrangements using vertical wells, particularly in that the oil produced by well P coming from a zone better located situated between the two drains 3*b*, 5*b*.

The advantage of horizontal wells over vertical wells is also that greater lengths of the reservoir are traversed, and improved characterization of the reservoir is possible from the measurements and samples collected from the well, mainly in the plane of the beds which is, preferably, that of the fluid flow. Since the reservoir is better known, interpretation of the test may be more accurate.

Such an arrangement hence implies a lower cost, particularly for thin and fairly deep reservoirs, partly because of the smaller number of wells and partly because of the smaller quantities of fluid injected, when chemical processes are employed.

This type of configuration applies preferably to thin sandstone hydrocarbon reservoirs (less than 10 m) having no continuous impermeable intercalated bed between the wells and with a small or zero initial pressure gradient.

The present invention also applies to a configuration represented in FIG. 3. It has three parallel horizontal drains 6*b*, 7*b*, 8*b* disposed as in the preceding embodiment and with the same conditions governing the distances and lengths. The arrangement is reversed. Center drain 4*b* is intended for injection and peripheral drains 6*b* and 8*b* for production. Thus, injection occurs at flowrate q in center drain 7*b*. In the case where there is viscous oil but no moving water in the reservoir before the pilot test, and low mobility (less than 1 m D/cP), a thermal injection may be made in such a configuration by producing wells 6*b*, 8*b* at most, without however exceeding the flowrate of q/2 for each one of them.

The reverse configuration may also be considered in the case of recovery under tertiary conditions, i.e. once the deposits have been flushed with water when the percentage of water in the wells is very high. The flowrate of wells 6*b*, 8*b* must be equal to q/2.

The present invention is equally valid in the case where essentially horizontal drains make a polygonal geometric shape in one plane of the reservoir and not a simple rectangle as before.

One need then only trigger in some of the drains a first state of either injection or production, the other drains being in a second state (injection or production) opposite the first state, and regulate the volumetric flowrates of injected and produced liquid such that the sum of the injection drain flowrates is essentially equal to the sum of the production drain flowrates.

Of course, the invention is not limited by the characteristics specified in the foregoing or by the details of the particular embodiment chosen to illustrate the invention. All types of changes may be made to the particular embodiment described as an example and to its component elements without thereby departing from the scope of the invention.

I claim:

1. Production simulation process by pilot test in a deposit of hydrocarbons contained in a thin reservoir with the aid of injection wells whereby a fluid is injected into said reservoir to displace said hydrocarbons to producing wells where the effluents are brought to the surface, characterized by said injection and production wells being wells drilled practically vertically from the surface, extended by drains which are substantially horizontal inside said reservoir, said horizontal drains forming, at least in part, a polygonal geometric shape in a reservoir plane;

a first state is triggered either by injection or by production for the drains located at the periphery of said geometric shape, a second state, opposite to said first state, is triggered either by injection or by production for the drains located inside said geometric shape and the volumetric flowrates of fluid injected and produced are regulated such that the sum of the flowrates of the injection drains is substantially equal to the sum of the flowrates of the production drains.

2. Production simulation process by pilot test according to claim 1 characterized by said geometric shape being a rectangle whose long sides are limited by two parallel horizontal drains, a third center drain being disposed parallel to and half-way between the first two, the two peripheral drains being made to inject or produce at a flowrate q/2, and the center drain being made to inject or produce at a flowrate q.

3. Production simulation process by pilot test according to claim 1 or 2 characterized by the injection fluid being steam.

4. Production simulation process by pilot test according to claim 1 or 2 characterized by the injection fluid being a chemical including a polymer.

5. Well-drilling arrangement for a pilot test used to implement the production simulation process according to claim 1 or 2 characterized by the horizontal drains being drilled essentially half-way between the roof and base of the reservoir.

6. Drilling arrangement according to claim 5 characterized by three horizontal drains being disposed in parallel in the reservoir and by X designating the horizontal length of each drain; Y designating the distance between two adjacent drains, H designating the vertical thickness of the reservoir which is a maximum of 10 m; and distances X and Y being chosen such that inequalities $Y \geqq 5H$ and $X \geqq 4Y$ are true.

7. Drilling arrangement according to claim 6, applied to a thin sandstone reservoir having no continuous impermeable intercalated bed between the drains and with a small initial pressure gradient.

8. Production stimulation process by pilot test according to claim 1, characterized by X designating the horizontal length of each drain; Y designating the distance between two adjacent drains; H designating the vertical thickness of the reservoir which is a maximum of 10 m; and distances X and Y being chosen such that inequalities $Y \geqq 5h$ and $X \geqq 4Y$ are true.

* * * * *